United States Patent [19]

Bresie et al.

[11] 4,139,019

[45] Feb. 13, 1979

[54] METHOD AND SYSTEM FOR TRANSPORTING NATURAL GAS TO A PIPELINE

[75] Inventors: Don A. Bresie; Donald W. Fowler, both of Austin, Tex.

[73] Assignee: Texas Gas Transport Company, Austin, Tex.

[21] Appl. No.: 758,154

[22] Filed: Jan. 10, 1977

Related U.S. Application Data

[63] Continuation-in-part of Ser. No. 651,242, Jan. 22, 1976, abandoned.

[51] Int. Cl.[2] ..... F17C 5/02

[52] U.S. Cl. ..... 137/351; 137/561 R; 137/569; 62/55; 48/190

[58] Field of Search ..... 137/1, 614, 561 R, 14, 137/565, 569; 48/190, 191; 62/54, 55

[56] References Cited

U.S. PATENT DOCUMENTS

| | | | |
|---|---|---|---|
| 784,067 | 3/1905 | Park | 137/614 |
| 3,232,725 | 2/1966 | Secord | 48/190 |
| 3,293,011 | 12/1966 | Lewis | 48/190 |

OTHER PUBLICATIONS

American Gas Journal; "Gas Hydrates in Natural Gas Pipe Lines" by Deaton, et al., Jun., 1937.

*Primary Examiner*—Alan Cohan
*Attorney, Agent, or Firm*—Bacon & Thomas

[57] ABSTRACT

Natural gas from one or more wells is gathered, dehydrated, compressed to a relatively high pressure, and loaded into pressure vessel means mounted for transporting at ambient temperatures by a transport vehicle. The pressure vessel means is then driven to a transmission pipeline terminal, or other end user, and the natural gas is off-loaded while being heated to prevent the formation of harmful hydrates, the gas being metered before flowing into the pipeline.

26 Claims, 4 Drawing Figures

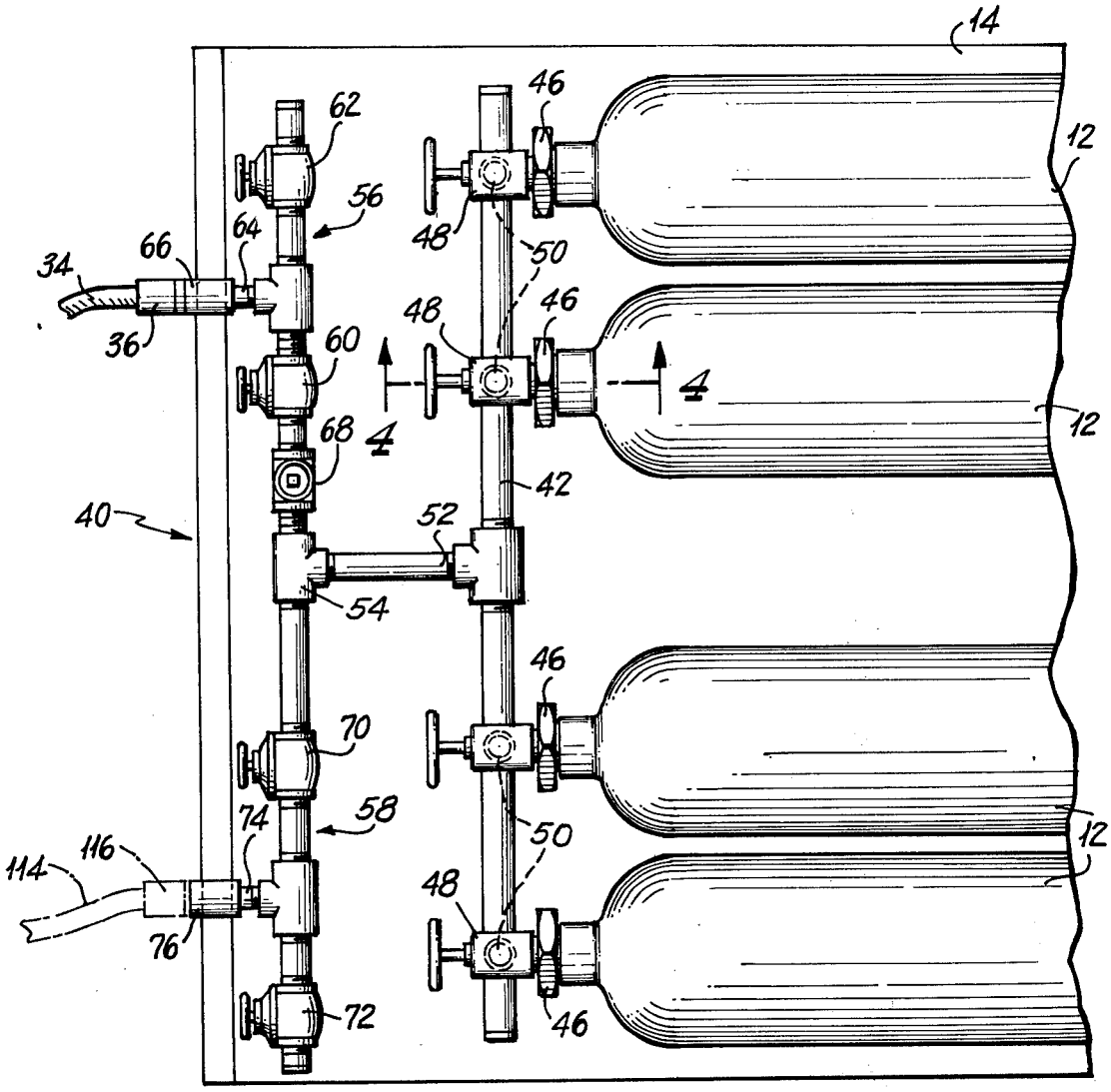
Fig. 3.
Fig. 4.
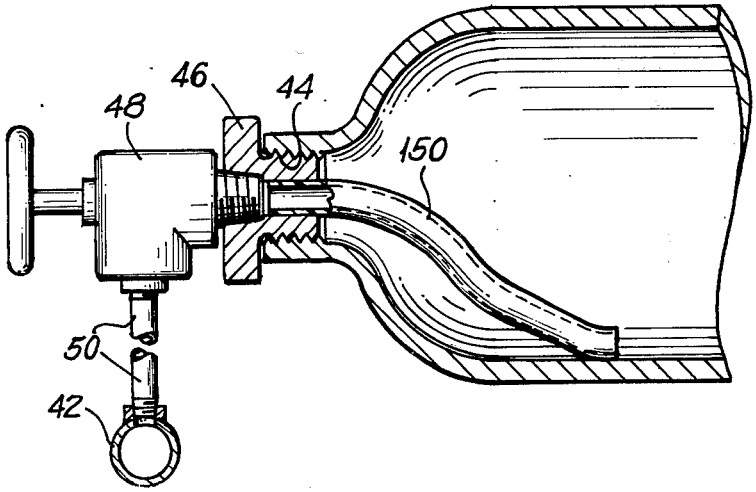

METHOD AND SYSTEM FOR TRANSPORTING NATURAL GAS TO A PIPELINE

This is a continuation-in-part of application Ser. No. 651,242, filed Jan. 22, 1976 now abandoned.

BACKGROUND OF THE INVENTION

1. Field of the Invention

The present invention relates generally to a method and a system for transporting natural gas between a gas well and a transmission pipeline, or other end user facility. More particularly, it relates to such a method and system particularly adapted to the economies involved with remotely located or low producing wells, where the cost of constructing a conventional feeder pipeline from the well head directly to a pipeline terminal or end point purchaser is excessive.

2. Description of the Prior Art

The distribution and use of natural gas for energy purposes is very widespread. The conventional manner for handling the natural gas is to build a feeder pipeline directly to the well head, which is then used to collect the gas and transport it to a terminal on a major transmission pipeline utilized to transport large volumes of natural gas over long distances to remote users. While this system has proven successful over the years in most instances, there are some situations where the economic costs involved are so excessive as to make use of natural gas from small reservoirs and certain wells impractical. This is especially true of low producing wells, and those wells that are isolated or located in remote places.

Over the time when an abundance of natural gas wells located in easily accessible locations existed to meet the needs for this form of energy, the ignoring of the output of natural gas from small reservoirs, and from low producing and poorly located wells, was of no great moment. But in this time of energy shortage, particularly the shortage of natural gas available to the major gas transmission pipeline systems, there is now a need for an economically feasible means for making use of the natural gas available from such wells.

Industry has previously developed special equipment for the commercial handling of what are called specialty gases, such as oxygen, acetylene, and in some instances, energy fuels. The key element in such equipment is an over-the-road motor vehicle carrying one or more pressure vessels, designed to transport the specialty gas safely under normal highway conditions. Among such vehicles for transporting specialty gases will be found semi-trailers for transporting specialty gases will be found semi-trailers including a plurality of cylindrical high pressure vessels, and capable of transporting perhaps 200,000 cubic feet of gas under high compression.

It has also been demonstrated that natural gas can be stored in refrigerated pressure vessels on board a ship, under relatively low pressures and at low temperatures, for transporting it over long distances across a body of water. Such a method for the storage and transportation of natural gas is described in U.S. Pat. No. 3,232,725, but has a disadvantage for large scale use on the land because of the need to keep the pressure vessels under refrigeration. The method of the patent requires refrigeration equipment and insulation to hold the compressed natural gas at sub-freezing temperatures, and such equipment and insulation occupies valuable space and adds weight in a land vehicle with the result that hauling capacity can be reduced and transportation costs increased to the point where economical transport of the natural gas cannot be accomplished.

The present invention is intended to solve the need for economically transporting natural gas from remote small reservoirs and low yield wells to a pipeline terminal, or other end user facility. It is particularly designed for economically transporting the natural gas over-the-road, and in this embodiment makes use of the general type of transport motor vehicles that have been developed for handling specialty gases, suitably modified to carry out the method of the invention. At the same time, the need for insulation and refrigeration of the cylindrical high pressure vessels, as required in U.S. Pat. No. 3,232,725, is eliminated, thereby greatly enhancing the economics of transporting the natural gas over-the-road.

While the present invention is particularly useful for transporting natural gas over-the-road, it can also be adapted for use with high pressure vessels transported by other means, such as by barge, rail or airplane. When these transport vehicles are employed, the elimination of the need for refrigeration equipment allows carrying a significantly heavier payload than in the past. Moreover, the unique loading and off-loading method and system of the invention is of equal value, regardless of the kind of transport vehicle utilized for the high pressure vessels.

SUMMARY OF THE INVENTION

In the method and system of the invention, a first terminal is built at the natural gas well site, and a second terminal is established at a terminal on a transmission pipeline, or at another end user location. The first and second terminals are especially equipped to handle the loading and off-loading of natural gas, respectively, the first terminal including a dehydrator unit to remove moisture from the gas, and a compressor for supplying it under pressure to the high pressure vessels carried by the transport vehicle means used to transport the gas. The transport vehicle, whether it is an over-the-road truck, a railroad car, a barge, or even an aircraft, carries a specially designed manifold system to facilitate loading and off-loading of the natural gas, quickly and with safety.

At the well site, natural gas is gathered from a plurality of gas wells through a gathering manifold system that includes a meter for each well, and a check valve arrangement to prevent back-flow toward the meter and its associated well. The check valve prevents gas from flowing from a gas well with a high well head pressure, into one having a lower well head pressure. The number of gas wells connected to the gathering manifold system is largely a matter of choice, involving decisions based on engineering and economics.

The compressor unit of the system is uniquely designed and arranged both to minimize problems of significant temperature drops normally associated with high pressure differentials when the output of a compressor unit is by-passed back to the inlet side thereof, and to make the system fail safe. Turning to the temperature drop problem, this is minimized in the invention by connecting the by-pass from the outlet of the compressor unit to the inlet of a pressure control valve feeding natural gas to the compressor unit from the gathering manifold system. This arrangement utilizes the usually relatively high pressure within the gathering manifold to minimize the pressure drop resulting from by-passing the output of the compressor unit.

The compressor unit arrangement is made fail safe by an over-ride switch, connected to a by-pass from the outlet side of the compressor unit. If the by-pass valve should fail and system pressure rise to an unacceptable level, the over-ride switch will turn off the compressor unit.

Once a transport vehicle has been loaded at the first terminal, it is simply driven or otherwise moved to the second terminal at the pipeline terminal, or other end user location. The natural gas is carried under high pressure, normally in excess of 1500 p.s.i., and under ambient temperature conditions. It has been found that by utilizing such high pressures, usually in the range of from 2000 to 3000 p.s.i., the natural gas can be successfully transported under ambient temperature conditions, without the need to refrigerate the pressure vessels. At the second terminal the gas is off-loaded through a flow monitoring system and control system, and flows into the pipeline, or a suitable storage vessel. The cylindrical pressure vessels are each fitted with a suction hose arranged to pick up any liquids that have accumulated therewithin, which are entrained with the natural gas and removed from the pressure vessels therewith.

It has been found that in off-loading natural gas at high pressures such as are contemplated in the invention, hydrates can form in the gas that are undesirable. The invention contemplates that heaters can be disposed in the off-loading system, to prevent this problem from occurring. This can make it possible to deliver the natural gas in a condition ready for transmission.

The method and system of the invention for transporting natural gas are at once simple and economical. The invention thus makes it possible to utilize the many so-called "shut in" natural gas wells to augment the supply of natural gas energy.

It is the principal object of the present invention to provide a method and system for economically transporting natural gas from a well to a terminal on a transmission pipeline or other end user facility, without the need for constructing the usual feeder pipeline directly to the well, or to use refrigerated pressure vessels.

Another object is to provide a system and method for transporting natural gas over-the-road between a well and a terminal on a transmission pipeline by use of a motor vehicle, designed to assure delivery of the natural gas in a condition satisfactory for transmission.

It is also an object to provide a method and system that not only is useable with over-the-road trucks as a transport vehicle, but which also is adaptable to other transport vehicle like railroad cars, barges and airplanes, and which insures more efficient use of such other vehicles than in the past.

A further object is to provide a system for gathering natural gas at the well head, pressurizing it for easy loading into pressure vessels carried by a transport vehicle, and off-loading the gas in good condition for use.

Yet another object is to provide a compressor unit arrangement for the system of the invention, designed to be fail safe in use, and to minimize temperature drops resulting from the by-passing of natural gas from the outlet side of the compressor unit to the inlet line thereof.

It is also an object of the invention to provide a vehicle manifold system for a transport vehicle carrying one or a plurality of pressure vessels, designed to ensure the quick and safe filling and emptying of the pressure vessels with natural gas.

Other objects and many of the attendant advantages of the present invention will become apparent from the following Description of the Preferred Embodiment, when taken in conjunction with the accompanying drawings.

BRIEF DESCRIPTION OF THE DRAWINGS

FIG. 3 is an enlarged diagrammatic view showing in particular the vehicle manifold system, and the bleed valve arrangements on both the loading and the off-loading sides thereof; and FIG. 4 is a vertical sectional view taken generally along the line 4—4 in FIG. 3, showing the suction hose arrangement for draining any accumulated liquids from the bottom of the cylindrical pressure vessels.

DESCRIPTION OF THE PREFERRED EMBODIMENT

The method and system of the present invention are especially effective for economically transporting natural gas over-the-road by motor vehicle, from the first terminal to the second. Hence, it is this embodiment of the invention that is described in detail herein.

However, it is to be understood that the present method and system can also be utilized with other transport vehicles, and their associated terminals. The choice of a transport vehicle can include motor trucks, railroad cars, barges, aircraft, and the like, or even a combination of these. In each instance the loading and off-loading method and system will function in the same manner, and a maximum payload will be carried by the high pressure vessel, with no less of weight or space to refrigeration equipment.

Given this explanation, it is to be understood that where a truck terminal is referred to herein, it might instead be a railroad terminal, or a terminal established to handle barges or aircraft. Similarly, the pressure vessels might be carried by some transport vehicle other than a motor truck. At the same time, it is again emphasized that the invention is especially useful for over-the-road transport of natural gas.

The value of the invention for over-the-road transport flows from several features thereof. First of all, by eliminating the need for refrigeration equipment associated with the high pressure vessels, valuable weight is saved that translates into a significantly greater payload of natural gas per trip. This is especially important in a motor vehicle, where highway and bridge weight limits must be observed. Further, the method and system of the invention provide for the safe and effective handling of the natural gas at truck terminals, utilizing relatively untrained personnel. In addition, the method and system make it possible to use the semi-trailer-carried pressure vessels already being manufactured for hauling certain specialty gases, with a limited amount of modification thereto. This results in considerable economies in carrying out the method.

Figure 1:
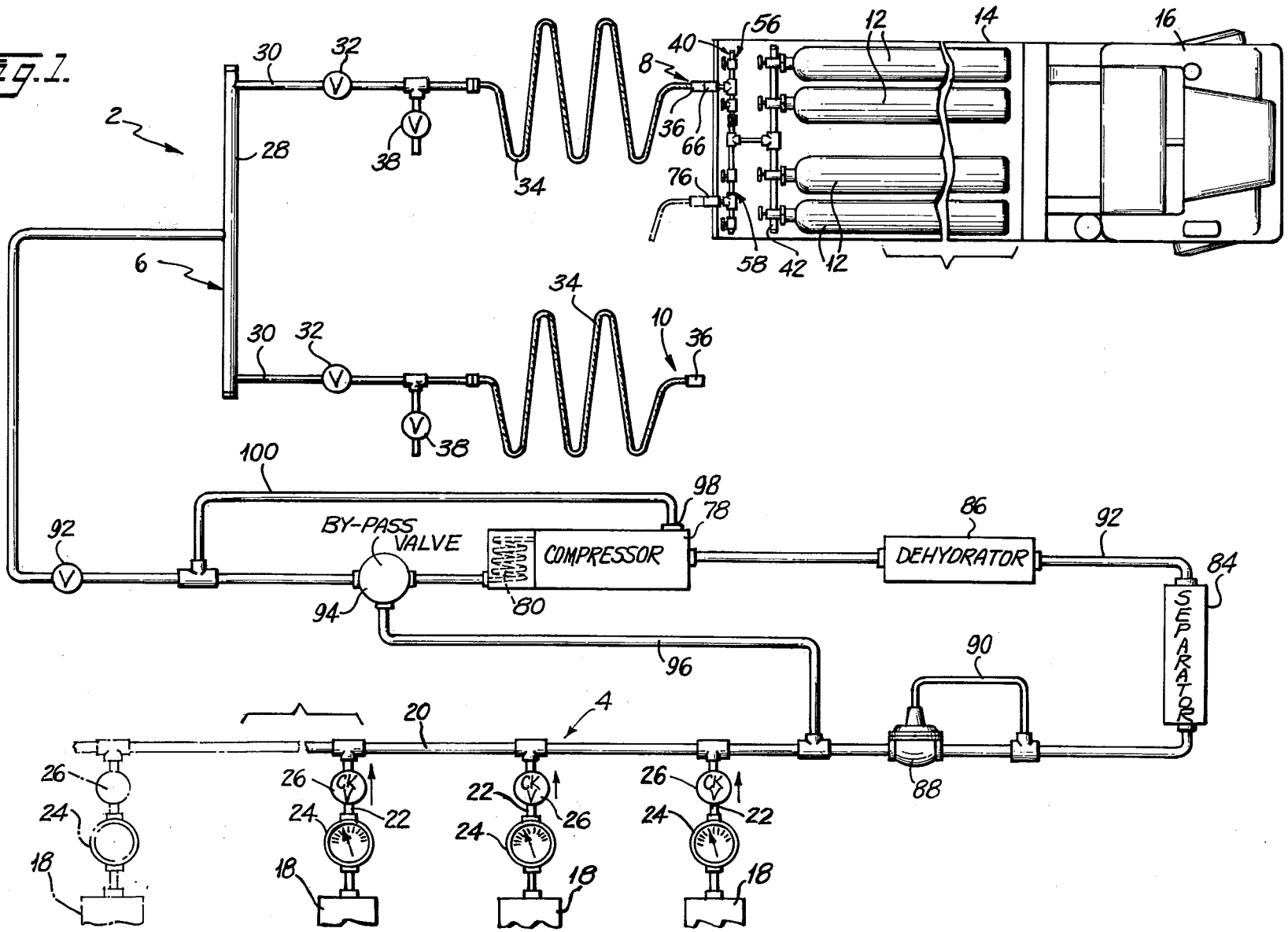
FIG. 1 is a diagrammatic view of the first terminal installation located at the well head end of the system of the invention, showing in particular the gathering manifold system, the dehydrator and the compressor arrangement utilized to prepare the natural gas for loading on the transport vehicle means, and the loading manifold system.

Referring now to the drawings, a first truck terminal, located at the natural gas well site, is indicated generally at 2 in FIG. 1, and includes a gathering manifold system 4, and a loading manifold system 6 having two truck-loading stations 8 and 10. The terminal 2 is arranged to load natural gas under pressure into the high pressure vessels 12 of semi-trailer motor vehicle units 14, which are designed to be drawn by a motorized cab 16 in the usual manner. While the loading manifold system 6 is shown arranged to handle two semi-trailer units 14, it is to be understood that the system could be enlarged, if desired, to handle a greater number of such units.

The gathering manifold system 4 is designed to gather natural gas from a plurality of gas wells 18. While only three gas wells 18 are shown in FIG. 1, it is to be understood that other wells can be added to the system, as indicated by broken lines at 18', or that as few as a single gas well might be connected thereto. A gathering manifold 20 extends to all of the gas wells 18, and each well is connected thereto by a conduit 22 having a flow meter 24 connected therein for measuring the amount of natural gas taken from the well. A one-way check valve 26 is also connected into each conduit 22, between its associated flow meter 24 and the gathering manifold 20, the check valves 26 functioning to prevent back-flow into the meters 24 and the gas wells 18 connected thereto. This arrangement is especially designed to meet the situation where well head pressure in one gas well is greater than that in other gas wells, and functions to prevent flow through the gathering manifold 20 from well to well.

The loading manifold system 6 includes a loading manifold 28 having a plurality of supply conduits 30 connected thereto, one for each truck loading station 8, 10. Each supply conduit 30 has a flow control valve 32 connected therein, and has a flexible hose 34 connected to its outer end. The outer end of the flexible hose 34 carries one-half 36 of a conventional quick connect-disconnect coupling thereon, and a bleed valve 38 is connected in the supply conduit 30 between the coupling element 36 and the flow control valve 32 so that pressure can be bled from the flexible hose 34 to allow safe operation of the coupling.

If desired, pipes with suitable swivel joints can be substituted for the flexible hoses 34. The choice of flexible hoses or tubing, or relatively rigid pipes, can depend on the location of the terminals and other factors.

Referring now to FIGS. 3 and 4, the semi-trailer 14 has a plurality of the cylindrical pressure vessels 12 mounted thereon, the number actually employed being a matter of choice, Indeed, in some instances only a single vessel 12 might be employed. A vehicle manifold system 40 is mounted on the rear end of the semi-trailer 14, and is especially designed to handle the loading and off-loading of natural gas. The system 40 includes a vehicle manifold 42 disposed across the ends of the pressure vessels 12, the latter having threaded inlets 44 in their ends, each receiving a collar fitting 46. A control valve 48 of conventional construction is carried by each fitting 46, and is connected to the vehicle manifold 42 by a conduit 50, which can be a flexible hose. Thus, each pressure vessel 12 can be connected and disconnected to the vehicle manifold 42 merely by operating its associated control valve 48.

The vehicle manifold 42 has one end of a transfer conduit 52 connected thereto, the other end of said transfer conduit having a T-branch fitting 54 thereon. A loading conduit system 56 is connected to one side of the T-fitting 54, and an off-loading conduit system 58 is connected to the other side thereof.

The loading conduit system 56 has a flow control valve 60 therein, and a bleed valve 62 at its outer end. Between the flow control valve 60 and the bleed valve 62 is an inlet stub 64, carrying half 66 of a quick connect-disconnect coupling, which coupling half 66 is designed to mate with the coupling half 36 carried by the flexible hose 34. The purpose for the bleed valve 62 is to allow all pressure to be drained from the fill conduit system 56, before the coupling halves 66 and 36 are disconnected.

Disposed between the flow control valve 60 and the T-fitting 54 is a one-way check valve 68, designed to permit flow only in a direction toward the T-fitting 54. Thus, back-flow from the pressure vessels 12 cannot occur.

The off-loading conduit system 58 includes a flow control valve 70, and has a bleed valve 72 at its outer end. Between the valves 70 and 72 is a discharge stub 74, carrying one-half 76 of a conventional quick connect-disconnect coupling. The coupling halves 66 and 76 can be of different design, to prevent the accidental coupling of the flexible hose 34 to the discharge conduit system 58; for example, one can be male, the other female.

Between the gathering manifold system 4 and the loading manifold system 6, the first terminal 2 includes a compressor unit 78 of suitable construction, and which preferably includes an after cooler 80. The compressor unit 78 is connected to the gathering manifold 20 by a conduit system 82, which includes in series a conventional oil/gas separator unit 84, followed by a dehydration unit 86 for removing moisture from the natural gas prior to compression thereof. In some gas wells, where the natural gas is free of oil, the separator unit 84 need not be employed in the system.

The normal standard for moisture allowable in pipelines is 7# water/mm cubic feet of gas. Where the gas taken from a gas well 18 exceeds this, the moisture must be removed. This is the purpose for the dehydration unit 86.

The present invention contemplates transporting natural gas in the pressure vessels 12 at a pressure in excess of 1500 p.s.i., and usually within the range of from 2000 p.s.i. to 3000 p.s.i. Where well head pressure is below this level, the purpose for the compressor unit 78 is to raise it into this range. If well head pressure is already in this desired operational range, the compressor unit 78 may not be initially required, but can become necessary during gas withdrawals when the well head pressure falls to a more normal value.

Flow through the conduit system 82 from the gathering manifold 20 is controlled by a pressure control valve 88, supplied with line pressure by a pressure conduit 90. The pressure control valve 88 functions to establish a relatively constant pressure in the conduit system 82 and the components thereof, regardless of the well head pressures of the different gas wells 18. This relatively constant system pressure offers several advantages, all of which contribute to efficient operation of the invention.

First of all, a relatively constant system pressure to the dehydration unit 86 assures a constant speed on the dehydrator pump, and relatively consistent drying of the natural gas. Second, by supplying the compressor unit 78 with natural gas at a relatively constant pressure, maximum operational characteristics are obtained, and a relatively constant filling time is achieved for the pressure vessels 12 on the semi-trailers 14.

A main flow control valve 92 is connected in the conduit system 82 before the loading manifold 28, and a by-pass control valve 94 is connected between the main flow control valve 92 and the compressor unit 78. The by-pass port of the valve 94 is connected by a by-pass conduit 96 to the inlet side of the pressure control valve 88.

Connecting the by-pass conduit 96 to the inlet side of the pressure control valve 88, rather than to the outlet side, offers unique benefits that constitute a desirable feature of the present invention. It is known that significant drops in temperature are associated with corresponding decreases in gas pressure, as when high pressure natural gas from the outlet of the compressor unit 78 is introduced to a low pressure region on the inlet side of the compressor unit. Given the operating pressures of the invention, it is possible that this pressure drop could result in creating temperatures in the range of −20° F. or greater, which could cause damage to the materials and construction techniques utilized in normal valve and other components.

By connecting the by-pass conduit 96 to the inlet side of the pressure control valve 88, pressure flowing from the compressor unit 78 is mixed with pressurized natural gas from the gathering manifold system 4, which will normally be at a significantly greater pressure than will natural gas on the outlet side of the valve 88. When the compressor unit 78 shifts to a by-pass mode, the pressure in the manifold gathering system 4 will build up to the highest well head pressure in the system, since there is then no flow from the manifold 20. Thus, the pressure drop incurred by the by-passing is minimized, as is the resultant temperature change.

In the event the temperature drop resulting from the by-passing produces operating temperatures that are too low, it may become necessary to put a heater on the by-pass conduit 96. If well head pressures are sufficiently high, however, this should not prove necessary, with the arrangement of the invention.

In operation, natural gas is pulled from the gas wells 18 through the gathering manifold 20 and the conduit system 82, by the compressor unit 78. The main control valve 92 is open to supply natural gas to the loading manifold system 6, and from there it is supplied through the flexible conduit 34 to the pressure vessles 12. When the pressure vessels 12 are filled to the desired operating pressure, the by-pass control valve 94 opens, and flow from the compressor unit 78 is routed by the by-pass conduit 96 to the inlet side of the pressure control valve 88. Thereafter, the compressor unit 78 in effect just recirculates the same gas.

Should the pressure build up too much in the conduit system 82 on the compressor side of the pressure control valve 88, pressure conducted through the conduit 90 will be effective to close the control valve. This acts as a safety shutdown of the system.

The compressor arrangement of the invention includes a further safety feature, designed to make the system fail safe. A high pressure over-ride switch 98 is connected to the compressor unit 78, and is operated by a conduit 100 connected to the conduit system 82 after the by-pass valve 94, but before the main flow control valve 92. The high pressure over-ride switch 98 acts as a compressor unit shut-down, should the by-pass valve 94 fail to function.

As has been noted, the compressor unit 78 includes an after cooler 80, which can be employed to increase the density of the natural gas by lowering its temperature. This allows a greater volume of natural gas per trailer load. It is to be noted, however, that the present method and system do not contemplate keeping the gas in a refrigerated condition during transport, which would require the use of heavy insulation and refrigeration systems that would significantly lower the carrying capacity of the semi-trailers 14. Rather, once placed in the pressure vessels 12 under high pressures in excess of about 1500 p.s.i., it is expected that the natural gas will be transported under ambient pressure conditions. It has been found that natural gas can be effectively transported in this manner, and that refrigeration to subfreezing temperatures is not necessary.

Figure 2:
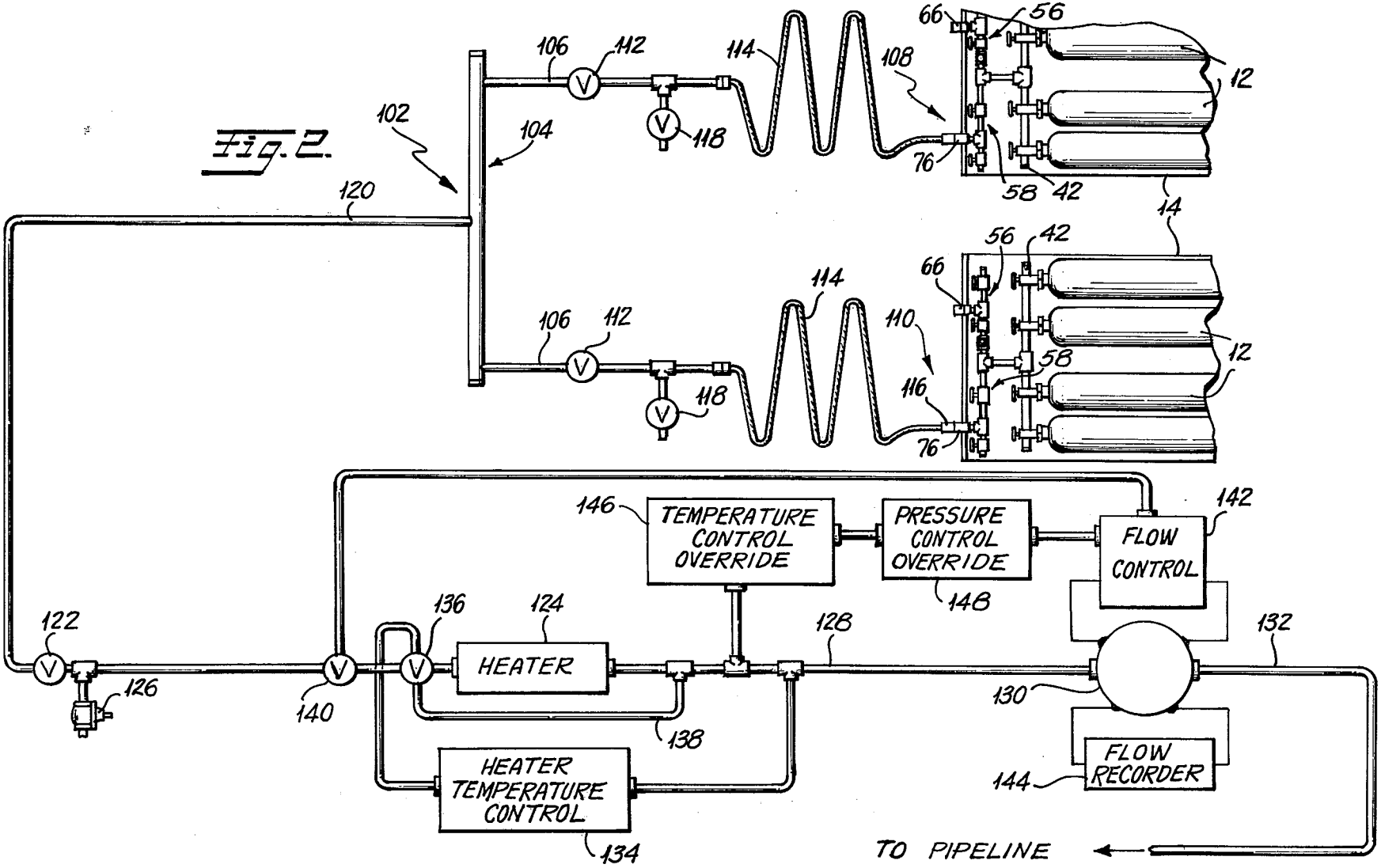
FIG. 2 is a diagrammatic view of the second terminal installation located at the terminal of the transmission pipeline, or other end user location, utilized for off-loading the natural gas from a transport vehicle, and showing in particular the heater system for preventing the formation of undesirable hydrates.

Turning now to FIG. 2, the second or off-loading terminal of the system of the invention is shown generally at 102, and includes an unloading manifold 104 having a pair of discharge conduits 106 connected thereto, one for each of a pair of off-loading stations 108 and 110. Each discharge conduit 106 includes a flow control valve 112, and has a flexible hose 114 connected thereto, the outer end of each hose 114 carrying one half 116 of a conventional quick connect-disconnect coupling, adapted to mate with the coupling half 76 on the semi-trailer 14. A bleed valve 118 is positioned between the flexible hose 114 and the flow control valve 112, and is utilized to bleed the system before the coupling valves 116 and 76 are disconnected.

As mentioned above for the flexible hoses 34, tubing or rigid piping with suitable swivel joints can be used instead, if such is desired. The need is for a movable conduit, in both cases.

Natural gas is collected from the unloading manifold 104 by a conduit 120, which leads through a main flow control valve 122 to a gas heater 124, a safety pressure relief valve 126 being connected to the conduit 120 after the flow control valve 122. The outlet of the gas heater 124 is connected by a conduit 128 to the inlet of a flow meter 130, the outlet of which is connected to a conduit 132 leading to the gas transmission pipeline, or possibly a storage vessel (not shown).

It has been found that when natural gas is discharged at a fast rate, such as will normally occur when releasing natural gas under high pressure from the pressure vessels 12, damaging hydrates can be formed. It has also been found that the possibility of such hydrates forming can be eliminated by use of the gas heater 124 of the invention. Thus, the system of FIG. 2 provides an effective means for releasing natural gas from the pressure vessels 12 in proper condition for its transmission through a pipeline, or for other end uses.

The temperature of the natural gas flowing through the conduit 128 is controlled by a heater temperature control unit 134, connected at one end to the conduit 128, and at its other end to the operating chamber of a by-pass valve 136 that is effective to channel natural gas from the conduit 120 either through the heater 124 or into a by-pass conduit 138. Flow through the heater 124 and hence the conduit 128, is ultimately under the control of a remotely operated control valve 140, controlled by a sensing unit 142 connected across the flow meter 130. Also connected across the meter 130 is a conventional flow recorder 144, and by knowing the temperature and the flow rae of the natural gas entering the conduit 128, the amount thereof can be accurately measured.

The pressure relief valve 126 is intended to provide emergency relief to the system. Further safety features include a temperature control over-ride sensing unit 146 and a pressure control over-ride sensing unit 148, both connected to the conduit 128, and connected through the sensing unit 142 to operate the remote flow control valve 140.

The method of the invention includes the steps of taking the nautral gas from a gas well gathering system at the gas well(s), compressing the gas to a pressure in excess of 1500 p.s.i., and usually to a pressure within the range of 2000 p.s.i. to 3000 p.s.i., loading the compressed natural gas into pressure vessel means mounted for transporting by a motor vehicle, transporting the pressure vessel means with the compressed gas therein at ambient temperatures to an end user terminal location, off-loading the compressed natural gas through conduit means, and heating the compressed natural gas as it flows through said conduit means to prevent the formation of hydrates. By transporting the natural gas at the indicated high pressures and under ambient pressure conditions, the use of heavy and space-occupying refrigeration equipment such as is required in the method of U.S. Pat. No. 3,232,725 is eliminated, with the result that natural gas can be economically transported over the road.

The method also contemplates passing the natural gas through a dehydration unit before it enters the compressor unit, if needed to remove moisture therefrom. Further, the method includes the step of passing the natural gas through a gas/oil separator, placed before the dehydrator unit, where such is required because of the nature of the flow from the gas well(s).

The manner in which the loading system of FIG. 1 functions to carry out the first portion of the method is believed obvious from the above description thereof. The pressure control valve 88 functions to supply natural gas at an even rate of flow to the separator unit 84 and the dehydrator unit 86, and ultimately to the compressor unit 78. The compressor unit 78 includes the cooling coils 80, which act to increase the density of the compressed gas, and the flow control valve 92 controls the supply of compressed natural gas to the manifold 28.

In order to load a semi-trailer unit 14, such is first placed at one of the loading stations 8 or 10, and the coupling halves 36 and 66 are then joined. The control valves 48 and 60 are opened, and then the main flow control valve 92 is opened to begin the flow of natural gas. AFter the pressure vessels 12 are filled, the individual control valves 48 thereon are closed, and the control valve 60 is closed. The main control valve 92 is closed to terminate the supply of natural gas, and thereafter the bleed valves 62 and 38 are operated to relieve pressure on the coupling elements 36 and 66. The quick connect-disconnect coupling is then diconnected, and the loaded semi-trailer 14 is ready for transport.

During loading of the pressure vessels 12, the pressure within the line leading thereto will reach a predetermined value, causing the by-pass valve 94 to operate, whereby the natural gas will be by-passed through the conduit 96 to the inlet side of the pressure control valve 88. As noted above, this point of connection of the by-pass conduit 96 will minimize temperature changes occurring from such by-pass of the compressed natural gas. Should pressure within the line 82 build above a pre-selected level, the pressure control valve 88 will simply close. In the event of component failure, the fail-safe switch 98 will act to close down the compressor unit 78.

Turning now to the second or off-loading terminal, unloading of the natural gas is carried out as follows. The coupling elements 116 and 76 are joined and the valves 48 and 70 are opened. The flow control valves 112 and 122 are then opened, and thereafter flow is controlled by the valve 140. The heater unit 124 is effective to heat the natural gas as it is unloaded, to prevent the formation of hydrates.

It has been found with the invention that some liquids can accumulate within the pressure vessels 12. In order to provide for removal thereof during off-loading, the pressure vessels 12 are each provided with a suction hose 150, shown in FIG. 4. The end of the hose 150 is secured in the fitting 46, and the other end thereof lies on the bottom of the pressure vessel 12, where any liquids will accumulate. As the natural gas is off-loaded, the liquids will simply be entrained therein, and will pass through the suction hose 150 and the conduit system.

When off-loading is complete, the valves 122 and 112 will be closed, along with the valves 48 and 70. Thereafter, the bleed valves 72 and 118 will be opened to relieve any pressure on the opposite sides of the quick connect-disconnect coupling, and then the coupling will be disconnected.

It is believed obvious from the above how the present method and system can be adapted for use with other kinds of transport vehicles and other kinds of vehicle terminals. The method of the invention remains the same, the equipment is substantially identical and functions in the same manner, regardless of the kinds of transport vehicles or terminals utilized.

The present method and system fulfill all of the objects set forth hereinabove for the invention, and make it possible to utilize the natural gas from wells which have heretofore been considered impossible to use. Thus, the available supply to natural gas energy is increased by the invention. In addition, the advantages offered by the invention will open further opportunities for exploring new natural gas wells, and will make it possible to bring such wells into production long before a collector pipeline system can be built.

Obviously, many modifications and variations of the present invention are possible.

What is claimed is:

1. A system for transporting natural gas from a gas well location to a terminal facility located at a delivery location, including:

pressure vessel means mounted for transporting by a transport vehicle, and including: at least one pressure vessel; and vehicle manifold means connected with said pressure vessel, and including vehicle coupling means;

a first terminal located at said gas well location, and including: means for gathering natural gas from gas well(s) at said gas well location; loading manifold means; loading coupling means for detachably connecting said loading manifold means with said vehicle coupling means; and a loading conduit means connecting said gathering means with said loading manifold means, said loading conduit means including compressor means, and said compressor means including:

a compressor unit;

a pressure control valve in said loading conduit means, located before said compressor unit; a by-pass flow control valve in said loading conduit means, located after said compressor unit; and a by-pass conduit connecting said by-pass flow control valve with the inlet side of said pressure control valve; and a second terminal located at said terminal facility at said delivery location, and including: off-loading manifold means; off-loading coupling means for detachably connecting said off-loading manifold means with said vehicle coupling means; and off-loading conduit means connected with said off-loading manifold means, and including heater means for heating compressed natural gas taken from said pressure vessel, to eliminate the formation of hydrates therein.

2. A system for transporting natural gas from a gas well location to a terminal facility located at a delivery location, including:

pressure vessel means mounted for transporting by a transport vehicle, and including: at least one pressure vessel; and vehicle manifold means connected with said pressure vessel, said vehicle manifold means including:

a manifold conduit;

conduit means connecting each pressure vessel with said manifold conduit;

a T-branch fitting connected with said manifold conduit;

a loading conduit means connected to one side of said T-branch fitting, and including in series, moving outwardly from said fitting: a check valve arranged to allow flow only toward said fitting; a flow control valve; one-half of a loading quick connect-disconnect coupling; and a bleed valve; and an off-loading conduit means connected to the other side of said T-branch fitting, and including in series, moving outwardly from said fitting: a flow control valve; one-half of an off-loading quick connect-disconnect coupling; and a bleed valve;

a first terminal located at said gas well location, and including: means for gathering natural gas from gas well(s) at said gas well location; loading manifold means; loading coupling means for detachably connecting said loading manifold means with said one-half of a loading quick connect-disconnect coupling; and a loading conduit means connecting said gathering means with said loading manifold means, said loading conduit means including compressor means; and a second terminal located at said terminal facility at said delivery location, and including: off-loading manifold means; off-loading coupling means for detachably connecting said off-loading manifold means with said one-half of an off-loading quick connect-disconnect coupling; and an off-loading conduit means connected with said off-loading manifold means, and including heater means for heating compressed natural gas taken from said pressure vessel, to eliminate the formation of hydrates therein.

3. A system for transporting natural gas from a gas well location to a terminal facility located at an end user location, said gas well location having a gas gathering system, and said transporting system including:

at least one pressure vessel means, mounted for transporting by a transport vehicle;

a first terminal located at said gas well, and including: a loading manifold, means for connecting said loading manifold with said pressure vessel, and including a flow control valve; and conduit means connecting said gas well gathering system with said loading manifold, and including: a dehydrator unit; a compressor unit connected after said dehydrator unit; and a main flow control valve connected between said compressor unit and said loading manifold; and a second terminal located at said end user location, and including: an off-loading manifold; means for connecting said off-loading manifold with said pressure vessel, and including a flow control valve; and conduit means connecting said off-loading manifold with said terminal facility, and including: a main flow control valve; a heater unit connected after said main flow control valve, for heating compressed natural gas to prevent the formation of hydrates therein; meter means connected after said heater unit for measuring the flow of natural gas to said terminal facility; a by-pass valve at the inlet of said heater unit; and a heater temperature control unit connected with said by-pass valve, and operable to control the temperature of natural gas flowing to said terminal facility from said heater unit.

4. A system as recited in claim 3, further including: a remote flow control valve connected before said heater unit, and operable by said meter means to control the rate of flow through said heater unit and said by-pass valve.

5. A system as recited in claim 4, further including: temperature and pressure over-ride means connected after said heater means, and arranged to operate said remote flow control valve to close the same should the temperature or the pressure, respectively, of natural gas being transported to said terminal facility exceed a preselected value.

6. In a system for transporting natural gas from a gas well location to a terminal facility located at an end user location, said system including a pressure vessel means mounted for transporting by a transport vehicle and having a vehicle coupling means, a first terminal for supplying natural gas under pressure to said pressure vessel means, including:

means for gathering natural gas from gas well(s) at said gas well location;

loading manifold means;

loading coupling means for detachably connecting said loading manifold means with said vehicle coupling means; and loading conduit means connecting said gathering means with said loading manifold means, and including:

a compressor unit;

a pressure control valve positioned between said gathering means and said compressor unit;

by-pass control valve positioned after said compressor unit; and a by-pass conduit connecting said by-pass control valve with the inlet side of said pressure control valve.

7. In a system as recited in claim 6, including additionally:

a main control valve positioned after said by-pass control valve.

8. In a system as recited in claim 6, including additionally:

a pressure over-ride switch connected to receive pressure from the outlet side of said compressor unit, and to close down said compressor unit when such pressure exceeds a preselected value.

9. In a system as recited in claim 6, wherein said means for gathering natural gas from gas well(s) at said gas well location includes:

a gathering manifold;

conduit means connecting each gas well with said gathering manifold;

meter means in each of said connecting conduit means; and a check valve in each of said connecting conduit means, arranged to permit flow only in a direction away from the associated gas well.

10. In a system as recited in claim 6, wherein said loading manifold means includes:

a loading manifold;

at least one loading conduit means connected with said loading manifold, and including on the outer end thereof a movable conduit terminating in one-half of a quick connect-disconnect coupling;

a flow control valve connected in said loading conduit means; and a bleed valve connected in said loading conduit means, on the outlet side of said flow control valve.

11. In a system as recited in claim 6, wherein said compressor unit includes an after cooler.

12. In a system for transporting natural gas from a gas well location to a terminal facility located at an end user location, said system including a pressure vessel means mounted for transporting by a transport vehicle and having a vehicle coupling means, a second terminal for off-loading natural gas from said pressure vessel means to said end user terminal facility, including:

off-loading manifold means;

off-loading coupling means for detachably connecting said off-loading manifold means with said vehicle coupling means; and off-loading conduit means connecting said off-loading manifold means with said terminal facility, including:

a main flow control valve;

a heater unit connected after said main flow control valve, for heating compressed natural gas to prevent the formation of hydrates therein;

meter means connected after said heater unit for measuring the flow of natural gas to said terminal facility;

a by-pass valve at the inlet of said heater unit; and a heater temperature control unit connected with said by-pass valve, and operable to control the temperature of natural gas flowing to said terminal facility from said heater unit.

13. In a system as recited in claim 12, wherein said off-loading manifold means includes:

an off-loading manifold;

at least one off-loading conduit means connected with said off-loading manifold, and including on the outer end thereof a movable conduit terminating in one-half of a quick connect-disconnect coupling;

a flow control valve connected in said off-loading conduit means; and a bleed valve connected in said off-loading conduit means, on the outlet side of said flow control valve.

14. In a system for transporting natural gas from a first terminal located at a gas well location to a second terminal located at an end user location, said first terminal including a loading manifold means for supplying natural gas under high pressure, and said second terminal including an off-loading manifold means, a pressure vessel means for transporting compressed natural gas between said first and said second terminals, including:

vehicle means;

at least one pressure vessel carried by said vehicle means; and a vehicle manifold means carried by said vehicle means and connected with said pressure vessel, said vehicle manifold means including:

a manifold conduit;

means connecting said manifold conduit with said pressure vessel;

a T-branch fitting connected with said manifold conduit;

a loading conduit means connected to one side of said T-branch fitting, and including in series, moving outwardly from said fitting: a check valve arranged to allow flow only toward said fitting; a flow control valve; one-half of a quick connect-disconnect coupling; and a bleed valve; and an off-loading conduit means connected to the other side of said T-branch fitting, and including in series, moving outwardly from said fitting: a flow control valve; one-half of a quick connect-disconnect coupling; and a bleed valve, said loading manifold means including one-half of a quick connect-disconnect coupling arranged to mate with said coupling half of said loading conduit means, and said off-loading manifold means including one-half of a quick connect-disconnect coupling arranged to mate with the coupling half to said off-loading conduit means.

15. In a system as recited in claim 14, wherein said means connecting said manifold conduit with said pressure vessel includes:

a connecting conduit extending between said pressure vessel and said manifold conduit; and a suction conduit within said pressure vessel, one end of said suction conduit being connected with said connecting conduit, and the other end thereof lying on the bottom of said pressure vessel and being effective to collect any liquids therefrom during off-loading.

16. In a system as recited in claim 15, wherein said means connecting said manifold conduit with said pressure vessel further includes:

flow control valve means connected in said connected conduit.

17. A system for transporting natural gas from a gas well location to a terminal facility located at a delivery location, including:

pressure vessel means mounted for transporting by a transport vehicle, and including: at least one pressure vessel; and vehicle manifold means connected with said pressure vessel, said vehicle manifold means including:

a manifold conduit;

means connecting said manifold conduit with said pressure vessel; and vehicle conduit means connected with said manifold conduit, and including in series, moving outwardly from said manifold conduit, flow control valve means; vehicle coupling means; and bleed valve means;

a first terminal located at said gas well location, and including: means for gathering natural gas from a gas well(s) at said gas well location; loading manifold means; loading coupling means for detachably connecting said loading manifold means with said vehicle coupling means, and including in series moving outwardly from said loading manifold, flow control valve means; bleed valve means; and a loading coupling connectable with said vehicle coupling means; and loading conduit means connecting said gathering means with said loading manifold means, said loading conduit means including dehydrator means connected therein; and a second terminal located at said terminal facility at said delivery location, and including: off-loading manifold means; off-loading coupling means for detachably connecting said off-loading manifold means with said vehicle coupling means, and including in series, moving toward said off-loading manifold means, an off-loading coupling connectable with said vehicle coupling means; bleed valve means; and flow control valve means; and off-loading conduit means connected with said off-loading manifold means.

18. A system as recited in claim 17, wherein said second terminal further includes:

heater means connected with said off-loading conduit means; and flow meter means for measuring the flow of natural gas in said off-loading conduit means, located after said heater means.

19. A system as recited in claim 17, wherein said vehicle coupling means, said loading coupling means, and said off-loading coupling include quick connect-disconnect couplers, said bleed valve means being arranged and operable to relieve pressure on said quick connect-disconnect couplers before such are opened.

20. A system as recited in claim 17, wherein said means for gathering natural gas from said gas well(s) includes:

a gathering manifold;

conduit means connecting each gas well with said gathering manifold; and check valve means in said connecting conduit means, arranged to permit flow only in a direction away from said gas well.

21. A system as recited in claim 20, including additionally:

meter means connected in each of said connecting conduit means.

22. A system as recited in claim 17, wherein said transport vehicle is a motor truck.

23. A system as recited in claim 17, wherein said loading conduit means further includes compressor means.

24. A system as recited in claim 23, wherein said first terminal further includes:

an oil/gas separator connected in said loading conduit means, before said compressor means.

25. In a system as recited in claim 6, wherein said loading manifold means includes:

a loading manifold;

at least one loading conduit means connected with said loading manifold, and including a coupling means;

a flow control valve connected in said loading conduit means; and a bleed valve connected in said loading conduit means, on the outlet side of said flow control valve.

26. In a system as recited in claim 17, wherein said means connecting said manifold conduit with said pressure vessel includes:

a connecting conduit extending between said pressure vessel and said manifold conduit; and a suction conduit within said pressure vessel, one end of said suction conduit being connected with said connecting conduit, and the other end thereof lying on the bottom of said pressure vessel and being effective to collect any liquids therefrom during off-loading.

* * * * *